US006047707A

United States Patent [19]

Johnson

[11] Patent Number: 6,047,707

[45] Date of Patent: Apr. 11, 2000

[54] HAIR GROOMING SYSTEM HAVING BOTH A CURLING ATTACHMENT AND A BRUSH ATTACHMENT

[76] Inventor: Donna J. Johnson, 2201 N. Broadway St. #169, New Ulm, Minn. 56073

[21] Appl. No.: 09/339,780

[22] Filed: Jun. 24, 1999

[51] Int. Cl.[7] ..... A45D 1/02

[52] U.S. Cl. ..... 132/232; 132/269

[58] Field of Search ..... 132/118, 229, 132/231, 232, 233, 234, 269; 219/222, 225, 226

[56] References Cited

U.S. PATENT DOCUMENTS

| | | | |
|---|---|---|---|
| 1,523,461 | 1/1925 | Swan | 132/118 |
| 2,530,196 | 11/1950 | Grierson | 219/225 |
| 3,935,423 | 1/1976 | Pucci | 132/118 |
| 3,955,064 | 5/1976 | Demetrio et al. | 132/232 |
| 4,496,825 | 1/1985 | Andis | 132/118 |
| 4,857,702 | 8/1989 | Cafaro | 132/232 |
| 5,435,327 | 7/1995 | Ho | 132/118 |
| 5,785,064 | 7/1998 | Simpson | 132/269 |

*Primary Examiner*—Todd E. Manahan

[57] ABSTRACT

A new Hair Grooming System having both a Curling Attachment and a Brush Attachment for allowing users to easily style their with minimal effort. The inventive device includes comprises a handle, a curling attachment and a brush attachment.

8 Claims, 4 Drawing Sheets

20
4
36
16
14
12
18
4
22
24
26
34

36
22
18
38
26
32
28
34

HAIR GROOMING SYSTEM HAVING BOTH A CURLING ATTACHMENT AND A BRUSH ATTACHMENT

BACKGROUND OF THE INVENTION

1. Field of the Invention

The present invention relates to hair grooming devices and more particularly pertains to a new Hair Grooming System having both a Curling Attachment and a Brush Attachment which allows users to easily style their hair with minimal effort.

2. Description of the Prior Art

The use of hair grooming devices is known in the prior art. More specifically, hair grooming devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair grooming devices include U.S. Pat. No. 4,851,641; U.S. Pat. No. 4,456,815; U.S. Pat. No. 3,859,497; U.S. Pat. No. 314,064; U.S. Pat. No. 4,034,201 and U.S. Pat. No. 4,604,514.

While these devices fulfill their respective, particular objectives and requirements, the aforementioned patents do not disclose a new Hair Grooming System having both a Curling Attachment and a Brush Attachment. The inventive device includes a handle, a modified curling attachment and a brush attachment.

In these respects, the Hair Grooming System having both a Curling Attachment and a Brush Attachment according to the present invention substantially departs from the conventional concepts and designs of the prior art, and in so doing provides an apparatus primarily developed for the purpose of allowing users to easily style their hair with minimal effort.

SUMMARY OF THE INVENTION

In view of the foregoing disadvantages inherent in the known types of hair grooming devices now present in the prior art, the present invention provides a new Hair Grooming System having both a Curling Attachment and a Brush Attachment construction wherein the same can be utilized for allowing users to easily style their hair with minimal effort.

The general purpose of the present invention, which will be described subsequently in greater detail, is to provide a new Hair Grooming System having both a Curling Attachment and a Brush Attachment apparatus and method which has many of the advantages of the hair grooming devices mentioned heretofore and many novel features that result in a new Hair Grooming System having both a Curling Attachment and a Brush Attachment which is not anticipated, rendered obvious, suggested, or even implied by any of the prior art hair grooming devices, either alone or in any combination thereof.

To attain this, the present invention generally comprises a handle, a modified curling attachment and a brush attachment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Hair Grooming System having both a Curling Attachment and a Brush Attachment apparatus and method which has many of the advantages of the hair grooming devices mentioned heretofore and many novel features that result in a new Hair Grooming System having both a Curling Attachment and a Brush Attachment which is not anticipated, rendered obvious, suggested, or even implied by any of the prior art hair grooming devices, either alone or in any combination thereof.

It is another object of the present invention to provide a new Hair Grooming System having both a Curling Attachment and a Brush Attachment which may be easily and efficiently manufactured and marketed.

It is a further object of the present invention to provide a new Hair Grooming System having both a Curling Attachment and a Brush Attachment which is of a durable and reliable construction.

An even further object of the present invention is to provide a new Hair Grooming System having both a Curling Attachment and a Brush Attachment which is susceptible of a low cost of manufacture with regard to both materials and labor, and which accordingly is then susceptible of low prices of sale to the consuming public, thereby making such Hair Grooming System having both a Curling Attachment and a Brush Attachment economically available to the buying public.

Still yet another object of the present invention is to provide a new Hair Grooming System having both a Curling Attachment and a Brush Attachment which provides in the apparatuses and methods of the prior art some of the advantages thereof, while simultaneously overcoming some of the disadvantages normally associated therewith.

Still another object of the present invention is to provide a new Hair Grooming System having both a Curling Attachment and a Brush Attachment for allowing users to easily style their hair with minimal effort.

Yet another object of the present invention is to provide a new Hair Grooming System having both a Curling Attachment and a Brush Attachment which includes a handle, a modified curling attachment and a brush attachment.

Still yet another object of the present invention is to provide a new Hair Grooming System having both a Curling Attachment and a Brush Attachment so that users have the versatility of using either attachment as needed.

Even still another object of the present invention is to provide a new Hair Grooming System having both a Curling Attachment and a Brush Attachment that provides a safe system that automatically turns its self off when left unattended for a period of time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
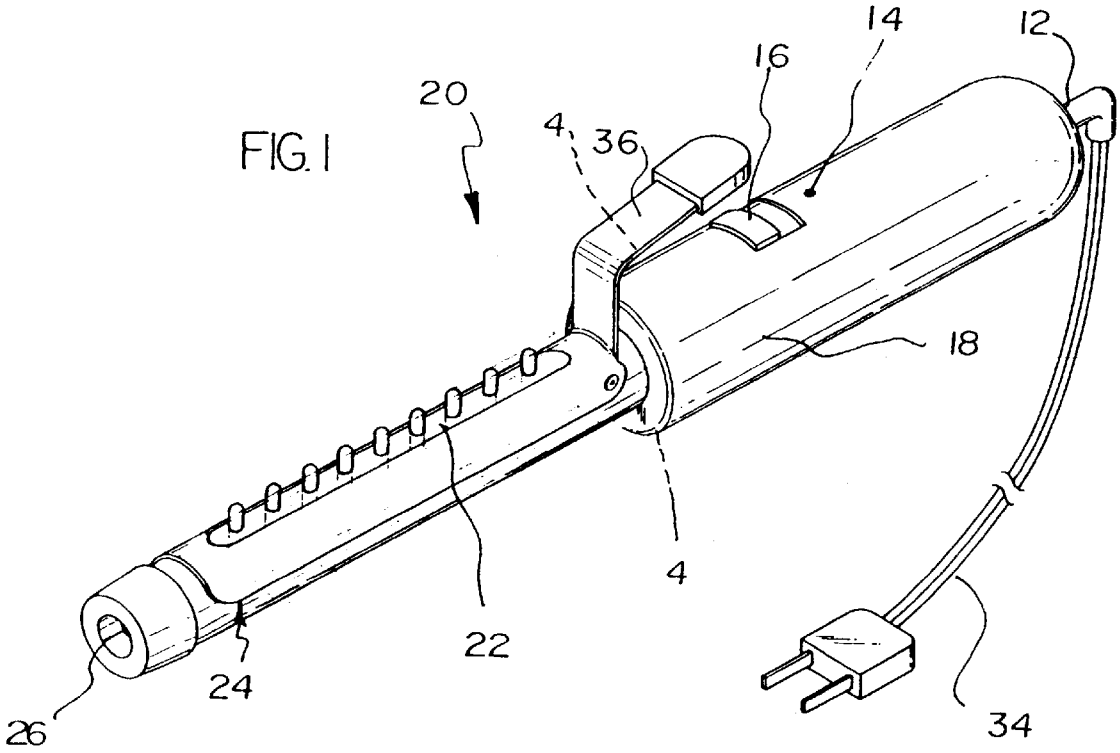
FIG. 1 is a right side perspective view of a new Hair Grooming Device System. Device according to the present invention particularly illustrating the device configured with the wrung attachment.
Figure 2:
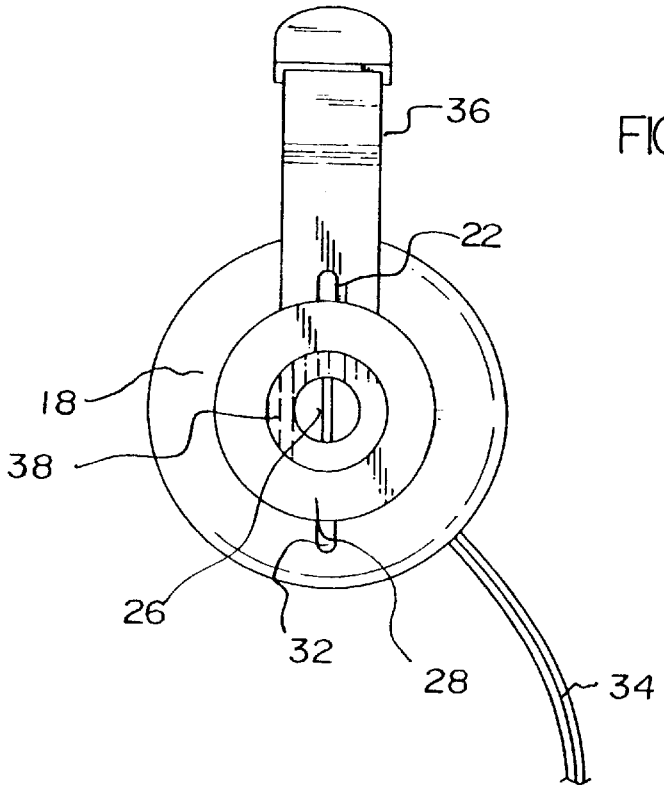
FIG. 2 is an end view of the Hair Grooming Device as shown in FIG. 1.
Figure 3:
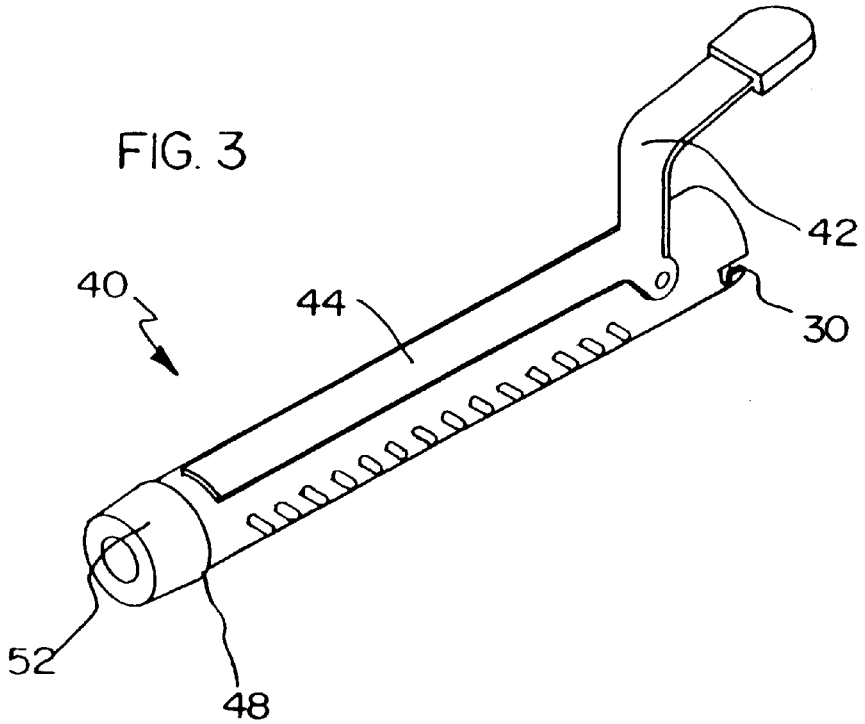
FIG. 3 is a top perspective view of the Hair Grooming Device configured with the brush attachment of the present invention.
Figure 4:
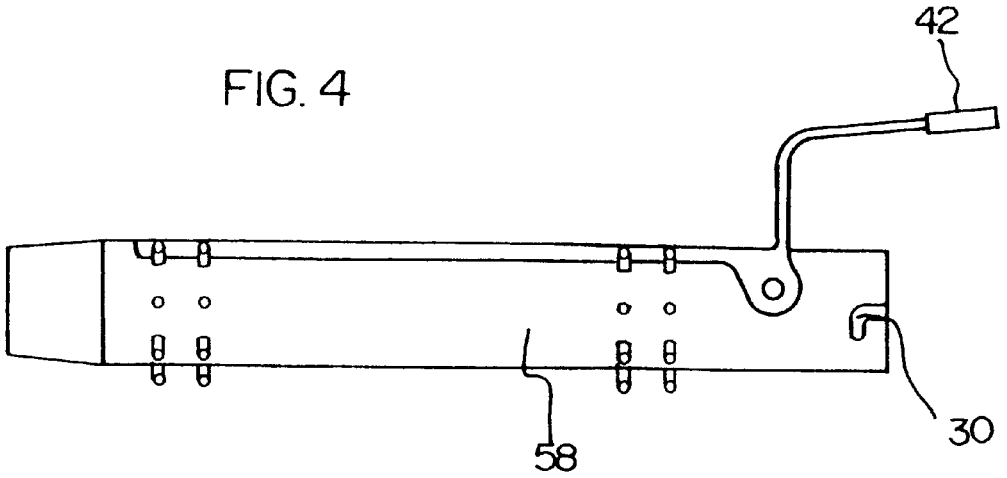
FIG. 4 is side view of the brush attachment of the present invention.
Figure 5:
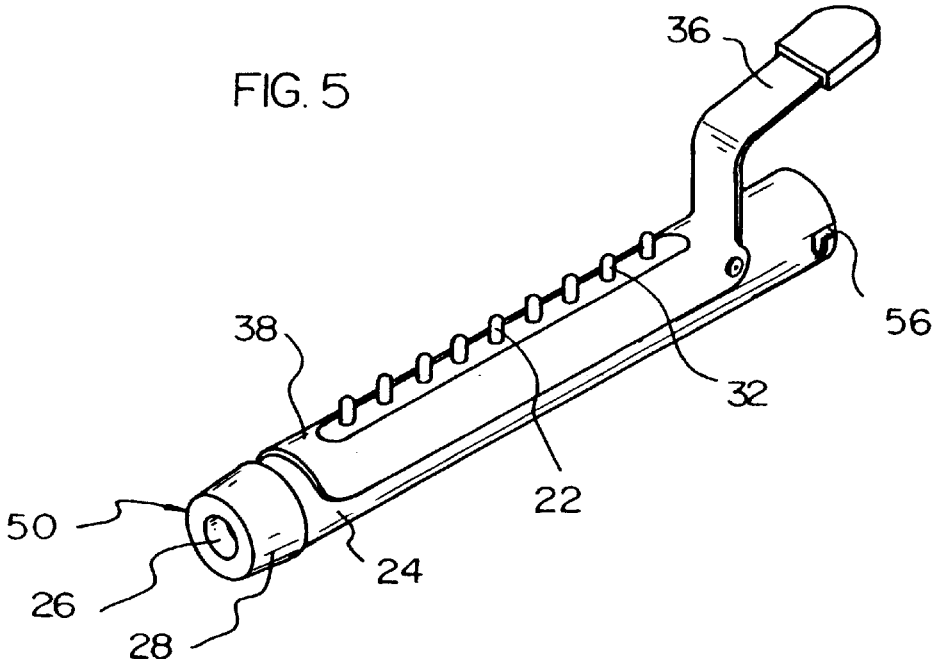
FIG. 5 is a right side perspective view of the wrung attachment of the present invention.
Figure 6:
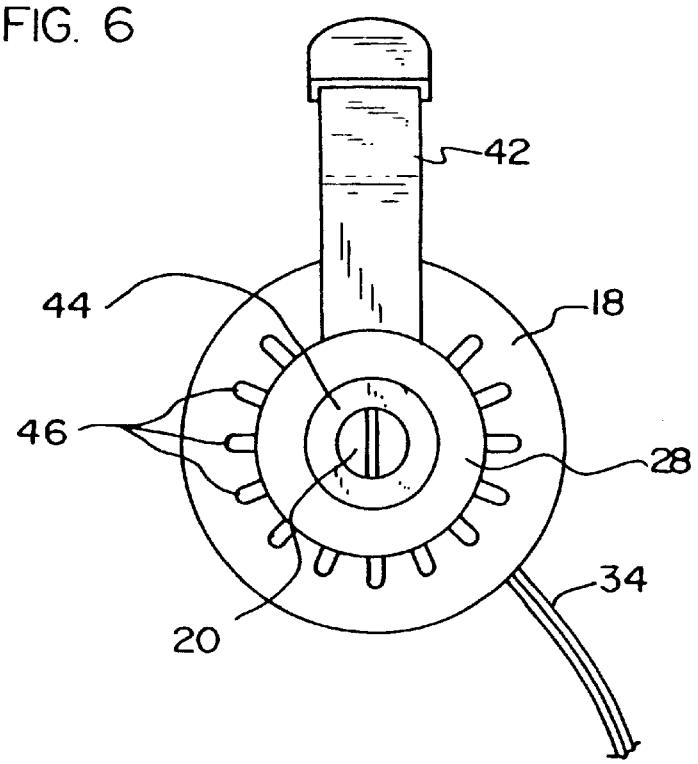
FIG. 6 is an end view of the Hair Grooming Device shown in FIG. 3 with the brush attachment of the invention.
Figure 7:
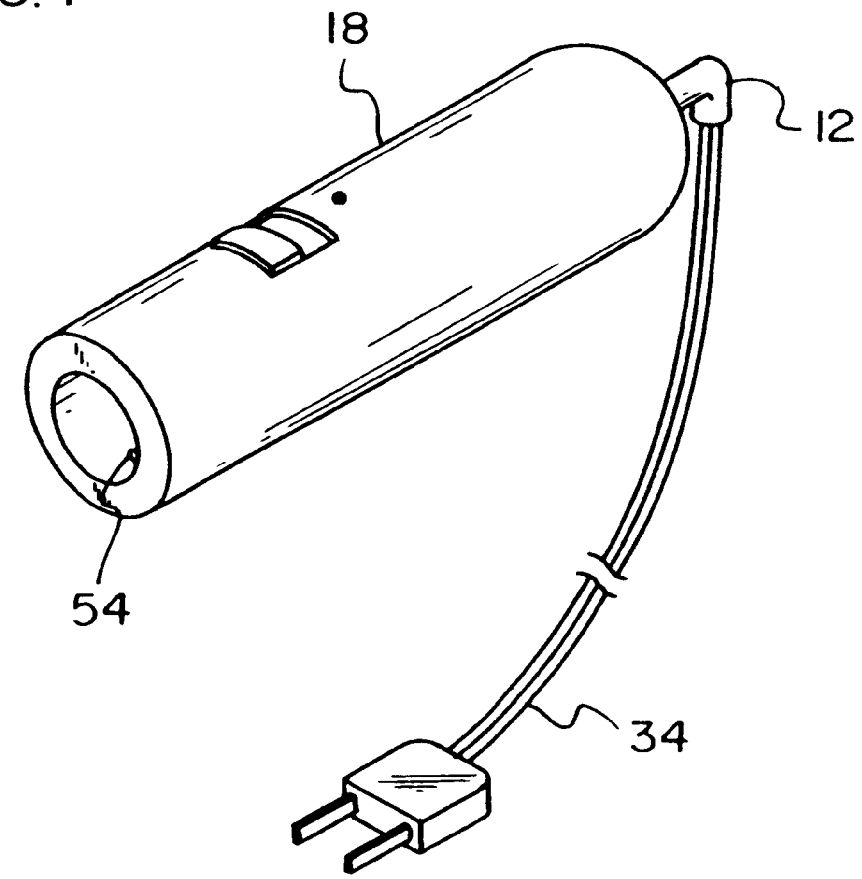
FIG. 7 is a right side perspective view of the handle portion of the present invention.

With reference now to the drawings, and in particular to FIGS. 1 through 7 thereof, a new Hair Grooming System having both a Curling Attachment and a Brush Attachment embodying the principles and concepts of the present invention and generally designated by the reference numeral 10 will be described.

More specifically, it will be noted that the Hair Grooming System having both a modified Curling Attachment and a Brush Attachment 10 comprises a handle, a curling attachment and a brush attachment.

The present invention is a new hair grooming device which generally allows users a greater measure of versatility in styling their hair. The present invention advantageously includes a curling attachment 20, a brush attachment 40, with a handle 18. The Hair Grooming System having both a Curling Attachment and a Brush Attachment includes a handle 18 which comprises a heating element and which allows a curling attachment 20, and a brush attachment 40 to be interchangeably connected to the handle 18.

The curling iron attachment 20 comprises a first metal barrel 24 and the brush attachment 40 comprises a second metal barrel 48. The first metal barrel 24 and the second metal barrel 48 are heated. The metal barrels 24 & 48 being adapted to be in thermal communication with the heating element, which is not shown, of the handle 18, when the attachments 20 & 40 are received by the mounting of the handle 18. The curling attachment 20 comprises a first clamping means 38 which is pivotally attached to the first support bar 36. The brush attachment 40 comprises a second clamping means 44 which is pivotally attached to a second support bar 42. The curling attachment 20 slidingly engages to the handle 18 by means of a first notch means 30.

The first clamping means 38 includes an elongated aperture 22, wherein the elongated aperture 22 allows a row of teeth means 32 to fit within the aperture 22, and the row of teeth means 32 are fixedly attached to the first metal barrel 24. The teeth means 32 comprises elongated plastic rods which is about ¼ inch in length, wherein there are at least about 10 rods fixedly attached to said first metal barrel 24.

The diameter of the first metal barrel 24 of the present invention ranges from about ½ inch to about 1½ inches, wherein the curling attachment 20 is held in position at a first end 50 of the first metal barrel 24 which is opposite to the first notch means 30 on the curling attachment 20 by screwing with a screw 26 a cap 28 onto the first metal barrel 24, wherein the brush attachment 40 slidingly engages to a handle 18 by means of a second notch means 42.

The brush attachment 40 comprises a plurality of teeth members 56. The teeth members 56 are fixedly attached in rows to the second metal barrel 48. The teeth members 58 are preferably formed of plastic. The diameter of the second metal barrel 48 of the present invention ranges from about ½ inch to about 1½ inches. The brush attachment 40 is held in position at a second end 52 of the second metal barrel 48 which is opposite to the second notch means 56 on the curling attachment 20 by screwing a cap 28 onto the second metal barrel 48 wherein the handle 18 comprises an off and on switch 16.

The handle 18 further comprises a protuberance 54 which is situated to allow the first notch 30 and the second notch 56 to be detachably attached to the handle 18. The handle 18 further comprises an indicator means 14, and the handle 18 further comprises a swivel means 12 pivotally attached to an end opposite the protuberance 54. The swivel means 12 is preferably pivotally connected to an electric chord 34 which extends at least about 60 inches in length.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A hair grooming apparatus comprising:

a handle member;

a curling iron attachment removably attachable to the handle member; and a brush attachment removably attachable to the handle member;

wherein the curling iron attachment comprises a first barrel with an attachment end and a tip end, a plurality of teeth arranged in a first linear row along an exterior surface of the first barrel and a plurality of teeth arranged in a second linear row along the exterior surface, the first and second linear rows extending in opposite directions from the first barrel, a first clamping member pivotally attached to the first barrel adjacent the attachment end, a first actuating member connected to the first clamping member such that movement of the first actuating member toward the first barrel moves the first clamping member away from the first barrel, the attachment end of the first barrel having a substantially cylindrical shape, the attachment end of the first barrel having a first notch, the first notch having an entry portion in communication with the attachment end of the first barrel and extending substantially parallel to the longitudinal axis of the first barrel, the first notch having a locking portion in communication with the entry portion and extending substantially perpendicular to the entry portion, the first clamping member having an elongated aperture for receiving the first row of teeth when the first clamping member is positioned adjacent to the exterior surface of the first barrel;

wherein the brush attachment comprises a second barrel with an attachment end and a tip end, a plurality of teeth arranged in a plurality of rows extending along an exterior surface of the first second barrel, a second clamping member pivotally attached to the second barrel adjacent the attachment end, a second actuating member connected to the second clamping member such that movement of the second actuating member toward the second barrel moves the second clamping member away from the second, the area of the exterior surface of the second barrel against which the second clamping members abuts being free of teeth, the attachment end of the first barrel having a substantially cylindrical shape, the attachment end of the first barrel having a second notch, the second notch having an entry portion in communication with the attachment end of the second barrel and extending substantially parallel to the longitudinal axis of the second barrel, the second notch having a locking portion in communication with the entry portion and extending substantially perpendicular to the entry portion, wherein the teeth comprise a plastic material;

wherein the handle member comprises a housing adapted for holding in the hand, a heating element located in the interior of the housing of the handle member, an on and off switch mounted on the housing for selectively supplying power to the heating element, the housing having opposite ends, a first one of the ends having a socket channel with a cylindrical interior wall defining the socket channel and an opening adjacent the first end of the housing adapted for receiving the attachment end of the first and second barrels, a protuberance positioned on the interior wall for being received in the first notch of the curling iron attachment and the second notch of the brush attachment such that movement of the protuberance into the locking potion of the notches locks the barrel on the handle member; and wherein each of the first and second barrels comprises metal, the metal of one of the barrels being in thermal communication with the heating element in the handle member when the attachment end of the barrel is inserted into the handle member.

2. The hair grooming apparatus of claim 1 wherein the teeth of the curling iron attachment comprise a plastic material, the teeth being about ¼ inch in length, each row of teeth comprising at least about 10 teeth, the first barrel having a diameter measuring from about ½ inch to about 1½ inches.

3. The hair grooming apparatus of claim 1 wherein the teeth of the brush attachment comprise a plastic material, the teeth being about ¼ inch in length, each row of teeth comprising at least about 10 teeth, the second barrel having a diameter measuring from about ½ inch to about 1½ inches.

4. The hair grooming apparatus of claim 1 wherein the handle member further comprises an indicator light for indicating the supply of power to the heating element.

5. The hair grooming apparatus of claim 1 wherein the handle member further comprises an electric supply cord connected to one of the ends of the housing.

6. The hair grooming apparatus of claim 5 wherein the electric supply cored extending at least about 60 inches in length.

7. The hair grooming apparatus of claim 1 wherein the plurality of rows on the second barrel comprises thirteen rows.

8. A hair grooming apparatus comprising:

a handle member;

a curling iron attachment removably attachable to the handle member; and a brush attachment removably attachable to the handle member;

wherein the curling iron attachment comprises a first barrel with an attachment end and a tip end, a plurality of teeth arranged in a first linear row along an exterior surface of the first barrel and a plurality of teeth arranged in a second linear row along the exterior surface, the first and second linear rows extending in opposite directions from the first barrel, a first clamping member pivotally attached to the first barrel adjacent the attachment end, a first actuating member connected to the first clamping member such that movement of the first actuating member toward the first barrel moves the first clamping member away from the first barrel, the attachment end of the first barrel having a substantially cylindrical shape, the attachment end of the first barrel having a first notch, the first notch having an entry portion in communication with the attachment end of the first barrel and extending substantially parallel to the longitudinal axis of the first barrel, the first notch having a locking portion in communication with the entry portion and extending substantially perpendicular to the entry portion, the first clamping member having an elongated aperture for receiving the first row of teeth when the first clamping member is positioned adjacent to the exterior surface of the first barrel, wherein the teeth comprise a plastic material, the teeth being about ¼ inch in length, each row of teeth comprising at least about 10 teeth, the first barrel having a diameter measuring from about ½ inch to about 1½ inches;

wherein the brush attachment comprises a second barrel with an attachment end and a tip end, a plurality of teeth arranged in a plurality of rows extending along an exterior surface of the first second barrel, a second clamping member pivotally attached to the second barrel adjacent the attachment end, a second actuating member connected to the second clamping member such that movement of the second actuating member toward the second barrel moves the second clamping member away from the second, the plurality of rows comprising thirteen rows, the area of the exterior surface of the second barrel against which the second clamping members abuts being free of teeth, the attachment end of the first barrel having a substantially cylindrical shape, the attachment end of the first barrel having a second notch, the second notch having an entry portion in communication with the attachment end of the second barrel and extending substantially parallel to the longitudinal axis of the second barrel, the second notch having a locking portion in communication with the entry portion and extending substantially perpendicular to the entry portion, wherein the teeth comprise a plastic material, the teeth being about ¼ inch in length, each row of teeth comprising at least about 10 teeth, the second barrel having a diameter measuring from about ½ inch to about 1½ inches; and wherein the handle member comprises a housing adapted for holding in the hand, a heating element located in the interior of the housing of the handle member, an on and off switch mounted on the housing for selectively supplying power to the heating element, the housing having opposite ends, a first one of the ends having a socket channel with a cylindrical interior wall defining the socket channel and an opening adjacent the first end of the housing adapted for receiving the attachment end of the first and second barrels, a protuberance positioned on the interior wall for being received in the first notch of the curling iron attachment and the second notch of the brush attachment such that movement of the protuberance into the locking potion of the notches locks the barrel on the handle member, wherein said handle member further comprises an indicator light for indicating the supply of power to the heating element, wherein said handle member further comprises an electric supply cord connected to one of the ends of the housing, the electric supply cord extending at least about 60 inches in length; and wherein each of the first and second barrels comprises metal, the metal of one of the barrels being in thermal communication with the heating element in the handle member when the attachment end of the barrel is inserted into the handle member.

* * * * *